United States Patent [19]

Tanihara

[11] Patent Number: 4,986,969

[45] Date of Patent: Jan. 22, 1991

[54] METHOD FOR RECOVERING GALLIUM VALUE FROM AQUEOUS SOLUTION OF CRUDE ALUMINUM SALT

[75] Inventor: Koichi Tanihara, Ogoori, Japan

[73] Assignee: Japan as represented by Director General of Agency of Industrial Science and Technology, Tokyo, Japan

[21] Appl. No.: 394,940

[22] Filed: Aug. 17, 1989

[30] Foreign Application Priority Data

Sep. 2, 1988 [JP] Japan ..... 63-220850

[51] Int. Cl.[5] ..... C22B 58/00

[52] U.S. Cl. ..... 423/115; 423/122

[58] Field of Search ..... 423/115, 122, 123, 124, 423/137, 367, 414

[56] References Cited

U.S. PATENT DOCUMENTS 4,135,917 1/1979 Badaliants ..... 423/129

OTHER PUBLICATIONS

A Textbook of Inorganic Chemistry, vol. 4, p. 149, (1917) by H. F. V. Little.

*Primary Examiner*—Jeffrey E. Russel
*Assistant Examiner*—Steven J. Bos
*Attorney, Agent, or Firm*—Wenderoth, Lind & Ponack

[57] ABSTRACT

An efficient method is proposed for the recovery of a trace amount of a gallium value from an aqueous solution containing a large amount of an aluminum salt as the principal solute as in the solution which is prepared by dissolving the precipitates obtained by neutralizing a Bayer's solution with carbon dioxide in hydrochloric or sulfuric acid. The method comprises admixing the aqueous solution with a water-soluble ferrocyanide compound, e.g., sodium ferrocyanide, as a precipitant of gallium ferrocyanide in such a controlled small amount as not to exceed 2.5 times by moles of the gallium ions in the starting solution so that coprecipitation of aluminum ferrocyanide is minimized.

2 Claims, No Drawings

METHOD FOR RECOVERING GALLIUM VALUE FROM AQUEOUS SOLUTION OF CRUDE ALUMINUM SALT

BACKGROUND OF THE INVENTION

The present invention relates to a method for recovering a gallium value from an aqueous solution of a crude aluminum salt. More particularly, the invention relates to a method for recovering a gallium value from an aqueous solution of an aluminum salt such as an aqueous solution of crude aluminum salt produced in the Bayer's process with an object to obtain a gallium material and to purify the solution of the aluminum salt relative to the content of gallium as an impurity.

As is well known, gallium is an element increasingly highlighted in recent years as a component element of various electronic functional devices such as light-emitting diodes, semiconductor lasers, field-effect transistors, magnetic sensors and the like and consumption of gallium compounds is rapidly increasing. In addition, the demand for gallium is expected to expand by leaps and bounds in the near future as a component element of so called compound semiconductors to replace traditional silicon semiconductors suitable for use as a high performance solar batteries and substrates of integrated circuits for high speed computers.

Occurrence of gallium is widely found throughout the crust of earth but gallium is a typical dispersed element for which no minerals or ores are known containing the element in such a concentration that the mineral or ore can be used as a natural raw material of the element in a metallurgical or refining process. In other words, any of known gallium resources richest in the content of gallium contains the element of gallium in a much lower concentration than the concentration having economical feasability as a raw material of the element. Accordingly, the resources of gallium currently in use are limited to the materials produced in the processing of a large amount of certain ores containing gallium in a concentration considerably higher than the average in the crust of earth. For example, it is known that a gallium value is contained in a somewhat increased concentration in solutions, precipitates flue dusts and the like in certain processes of chemical treatment of inorganic materials starting from bauxite and several zinc ores as a raw material and these in-process materials can be used as a starting material for obtaining the gallium value. Currently, gallium is obtained in most cases from the so-called Bayer's solutions produced in the manufacturing process of alumina starting from bauxite and precipitates obtained in the metallurgical process of zinc as the principal sources of gallium supply. Unfortunately, the concentration of gallium these sources still very low so that the economical utilizability of these gallium sources largely depends on the efficiency of the technology applied to the enrichment and recovery of the gallium value from the source materials.

The efficiency in the recovery of the gallium value in the prior art method is too low to be economically feasible despite the use of very specific and expensive adsorbents, extractants and solvents and the troublesomeness of the process in addition to the disadvantages of a great loss or consumption of the solvent and extractant and the instability of the adsorbent. Therefore, the technology for the recovery of a gallium value has been established only for the above mentioned gallium-containing materials as a gallium source in which the concentration of gallium is relatively high. For example, Bayer's solutions can be used as a gallium source in the prior art technology only when the content of gallium therein is 100 to 200 mg per liter or higher and no economical method is known for the Bayer's solution of lower gallium concentrations or for the solutions obtained in a low-alkalinity Bayer's process.

As is known, the principal solute in a Bayer's solution is sodium aluminate and, when the solution is neutralized by blowing carbon dioxide gas thereinto to decrease the alkalinity, both of the aluminum and gallium values precipitate in the form of hydroxide or basic carbonates which can be separated from the solution by a known method of solid-liquid separation. The thus obtained liquid portion can be transferred to the process for the recovery of sodium carbonate. The coprecipitates of both of a major amount of the aluminum value and a trace amount of the gallium value are dissolved in sulfuric or hydrochloric acid to give an aqueous solution of aluminum sulfate or chloride as the principal solute and the corresponding gallium salt as a trace impurity.

The above obtained aqueous solution containing the aluminum salt as the principal solute can of course be used as a source material of gallium provided that an efficient method is established for the recovery of the gallium value. Several known methods may be worthwhile for consideration as a method for the separation of the gallium value from an overwhelmingly large amount of the aluminum value including the methods of solvent extraction and anion exchange utilizing the greatly differing behavior of chloro-complex formation between these two elements, adsorption method by the use of a chelate resin, adsorptive resin or inorganic ion exchanger having selective adsorptivity for gallium and so on. These prior art methods are not satisfactory in respect of the efficiency for the recovery of the gallium value if not to mention the economical disadvantage as a consequence of the complicate process and the use of special and expensive solvents, extractants and adsorbents in large quantities. In particular, no practical method worthy to be considered is known for the recovery of the trace gallium value from an aqueous solution containing aluminum sulfate in a high concentration.

As a general guide principle, the method of precipitation utilizing a precipitation reaction is industrially the most Preferable for the recovery of a trace ingredient from an aqueous solution because the process is simple and convenient and suitable for the processing of a large volume of the solution if the precipitation reaction is complete by using a relatively small amount of the precipitant and no particular difficulties are encountered in the solid-liquid separation of the precipitates from the mother liquor. When recovery of a trace amount of a gallium value is intended from an aqueous solution of an aluminum salt in a high concentration, however, no practical precipitation method is known because the selective precipitation of the gallium value can never be complete as a consequence of the great similarity in the precipitation behavior of these two elements belonging to the same group in the Periodic Table.

It has long been known in the analytical chemistry since nearly a century ago that gallium ions can be precipitated from an aqueous solution by the addition of a soluble ferrocyanide. It is generally understood that, when selective precipitation of gallium is desired from an aqueous solution in the coexistence of aluminum ions, the precipitation reaction must be conducted in the presence of hydrochloric acid in a high concentration because aluminum ferrocyanide is not precipitated in an aqueous solution containing hydrochloric acid in a high concentration as is reported by P. B. Browning and L. E. Porter in American Journal of Science, volume 44, pages 221–224 (1917). In other words, this knowledge in the analytical chemistry teaches that coprecipitation of aluminum ferrocyanide with gallium ferrocyanide would predominantly take place when the concentration of hydrochloric acid is low in the aqueous solution. At least no attempts have been successful in recovering a gallium value by the precipitation method from an aqueous solution containing a large amount of an aluminum salt.

SUMMARY OF THE INVENTION

The present invention accordingly has an object to provide a novel and efficient method for the recovery of a gallium value by the precipitation method from an aqueous solution containing an aluminum salt in a high concentration.

Thus, the method of the present invention for the recovery of a gallium value from an aqueous solution containing an aluminum salt in a high concentration and a trace amount of gallium ions comprises the steps of;

(a) admixing the aqueous solution with a ferrocyanide compound soluble in water to selectively precipitate the gallium value in the form of gallium ferrocyanIde; and (b) separating the precipitates of the gallium ferrocyanide from the solution.

In particular, it is important that the amount of the ferrocyanide compound added to the aqueous solution is in the range from 1.0 to 2.5 times by moles of the gallium ions contained in the aqueous solution when the concentration of gallium in the aqueous solution is larger than 50 mg/liter and at least equimolar to gallium but not exceeding about $1.8\times10^{-3}$ mole/liter when the concentration of gallium in the aqueous solution does not exceed 50 mg/liter.

DETAILED DESCRIPTION OF THE PREFERRED EMBODIMENTS

As is understood from the above given description, the scope of the inventive method for the efficient recovery of a gallium value from an aqueous solution of an aluminum salt in a high concentration consists in the addition of a soluble ferrocyanide compound in a relatively small controlled amount to the aqueous solution. By this means, a possibility is given that the gallium value contained in the aqueous solution can be selectively precipitated and recovered in a yield of 90% or higher even when the concentration of the aluminum salt in the aqueous solution is near to saturation with little or a greatly reduced amount of coprecipitated aluminum ferrocyanide.

The water-soluble ferrocyanide compound used as the precipitant in the inventive method is not particularly limitative provided that the compound is an electrolyte capable of producing ferrocyanide ions in water including sodium ferrocyanide, potassium ferrocyanide ferrocyanic acid and the like as the preferable examples. Assuming that no interfering materials are contained in the aqueous solution, the gallium value can be precipitated almost completely from an aqueous solution of 50 mg gallium per liter in which the principal solute is aluminum chloride or sulfate in a concentration near to saturation by the addition of the water-soluble ferrocyanide compound in an amount of 2 to 2.5 times by moles of the amount of the gallium value in the solution Thus, it would be a more efficient way that the concentration of the aluminum salt in the precipitation medium is increased as high as possible in view of the above mentioned unique feature that precipitation of the gallium value is almost complete even when the concentration of the aluminum salt is near to saturation.

It is generally known that the solubility of a salt hardly soluble in water, e.g., gallium ferrocyanide, is increased so much as the concentration of a coexisting hetero electrolyte e.g.. aluminum chloride and sulfate, is increased as a result of the decrease in the activity coefficient. It would be a natural consequence that, since aluminum ferrocyanide also belongs to the class of hardly soluble salts, the solubility of aluminum ferrocyanide should be decreased in the presence of a large amount of aluminum ions coexisting in the solution due to the common ion effect To the contrary to this established knowledge in chemistry, nevertheless, it has been quite unexpectedly and surprisingly discovered that selective precipitation of a trace amount of a gallium value is so complete even from an aqueous solution of which the principal solute is aluminum sulfate or chloride in an extremely high concentration.

The amount of added water-soluble ferrocyanide compound to the aqueous solution should be in the range from equimolar to the content of the gallium ions in the solution to 2.5 times by moles thereof when the concentration of the gallium value in the solution is higher than 50 mg/liter and should be at least equimolar to the content of gallium but the concentration thereof in the solution should not exceed about $1.8\times10^{-3}$ mole/liter when the concentration of the gallium value in the solution does not exceed 50 mg/liter. Addition of the water-soluble ferrocyanide compound as the precipitant n an amount larger than the above mentioned upper limit is undesirable in respect of the increased coprecipitation of aluminum ferrocyanide and contamination of the aluminum value left in the solution with the excess of the precipitant compound. It has been found additionally that, when the aqueous solution of the aluminum salt contains iron as an impurity, the iron impurity can be coprecipitated with the gallium ferrocyanide so that the aluminum value in the solution can be purified relative to the iron impurity by appropriately selecting the amount of the water-soluble ferrocyanide compound added without decrease in the recovery of the gallium value.

Any known method is applicable to the solid liquid separation of the precipitates from the mother liquor including the method of spontaneous settling, filtration and centrifugation. When the method of spontaneous settling is followed, five days or longer of standing is usually sufficient to obtain a completely clear supernatant so that the applicability of this method covers the treatment in any industrial large scale. This advantage is obtained presumably due to the flocculating effect of the coexisting aluminum ions contained in a high concentration in the aqueous solution.

The method of the invention is applicable to any aqueous solutions of which the principal solute is an aluminum salt containing a minor or trace amount of a gallium value but the most successful results can be obtained when the aqueous solution contains aluminum sulfate or chloride in a high concentration and the concentration of the gallium value therein is in the range from several tens to several hundreds of milligrams per liter. According to the inventive method, the gallium value contained in an aqueous solution can be highly concentrated and recovered in a high yield with an extremely small amount of the precipitant added to the solution which otherwise may cause a serious contamination of the aluminum value left in the solution.

In the following, the method of the invention is described in more detail by way of examples using simulated solutions containing salts of aluminum and gallium each in a specified concentration. The examples described below should not be construed to be restrictive of the scope of the invention in any way and, needless to say, exact conditions of the method should be adequately selected in consideration of the state of the starting solution and other factors in the following examples, the quantitative determination of gallium and iron was conducted by the Rhodamine B method and by the Zeeman-type atomic absorption spectrophotometric method, respectively.

EXAMPLE 1

(Experiments 1 to 8)

Eight aqueous solutions of aluminum chloride in a concentration of 1 to 80 g/liter as aluminum were prepared and admixed with gallium chloride in a concentration of 62.5 mg/liter as gallium containing iron as an impurity in a trace concentration. Each a 8 ml portion of the solutions was taken in an Erlenmeyer flask with a screw stopper and 2 ml of an aqueous solution of sodium ferrocyanide in a concentration of $3.586\times10^{-3}$ mole/liter were added in drops to the solution in the flask under moderate agitation with a magnetic stirrer. The amount of the ferrocyanide ions $[Fe(CN)_6]^{4-}$ was equimolar to the gallium ions in the solution. After 1 hour of further continued agitation with the magnetic stirrer, the flask was screw-stoppered and shaken for 24 hours in an incubator thermostatted at 25° C. Thereafter, the solution in the flask was filtered through a membrane filter of 0.3 μm pore diameter and the filtrate was analyzed for the concentrations of gallium and iron to give the results shown in Table 1 below, which also gives the concentration of aluminum chloride in the starting aqueous solution calculated as aluminum and the precipitation of the gallium value.

TABLE 1

| Expt. No. | Al concentration, g/liter | Concentration in filtrate Ga, mg/liter | Fe, mg/liter | % precipitation of Ga |
|---|---|---|---|---|
| 1 | 1.12 | 0.05 | 1.3 | 99.9 |
| 2 | 5.62 | 0.13 | 2.1 | 99.7 |
| 3 | 16.86 | 0.41 | 1.2 | 99.0 |
| 4 | 28.10 | 1.08 | 0.4 | 97.8 |
| 5 | 39.35 | 1.93 | 0.2 | 96.1 |
| 6 | 50.59 | 3.07 | Trace | 93.9 |
| 7 | 62.39 | 4.29 | Trace | 91.4 |
| 8 | 78.68 | 8.16 | 9.5 | 83.7 |
| 9 | 62.39 | 0.26 | 2.3 | 99.5 |
| 10 | 78.68 | 1.05 | 8.8 | 97.9 |

EXAMPLE 2

(Experiments 9 and 10)

The experimental procedure in Experiments 9 and 10 was substantially the same as in the preceding example except that the concentration of the aqueous solution of sodium ferrocyanide was increased to $5.380\times10^{-3}$ mole/liter so that the amount of the ferrocyanide ions added to the solution was 1.5 times by moles of the gallium value contained in the starting aqueous solution. The results are shown also in Table 1.

EXAMPLE 3

(Experiment 11)

An aqueous solution of aluminum chloride in a concentration of 54.95 g/liter as aluminum was prepared and admixed with gallium chloride in a concentration of 165 mg/liter as gallium containing iron as an impurity in a trace concentration. A 9.1 ml portion of the solution was taken in an Erlenmeyer flask with a screw stopper and 0.9 ml of an aqueous solution of sodium ferrocyanide in a concentration of $3.586\times10^{-2}$ mole/liter was added in drops to the solution in the flask under moderate agitation with a magnetic stirrer. The amount of the ferrocyanide ions $[Fe(CN)_6]^{4-}$ was 1.5 times of the equimolar amount to the gallium ions in the solution. After 1 hour of further continued agitation with the magnetic stirrer, the flask was screw stoppered and shaken for 24 hours in an incubator thermostatted at 25° C. Thereafter, the solution in the flask was transferred into a glass vial of 10 ml capacity and kept standing in a dark place for 5 days and the supernatant was taken and analyzed for the concentrations of gallium and iron to give the results of 0.41 mg/liter and 7.14 mg/liter, respectively The precipitation of the gallium value was 99.7%.

EXAMPLE 4

(Experiment 12)

The experimental procedure was substantially the same as in the preceding example except that the concentration of iron in the starting aqueous solution was 55 mg Fe/liter. The analysis of the supernatant for the concentrations of gallium and iron gave values of 3.22 mg/liter and 1.6 mg/liter, respectively. The precipitation of the gallium value was 97.9%.

EXAMPLE 5

(Experiments 13 to 18)

Aqueous solutions of aluminum sulfate in the concentration of 50 g/liter as aluminum and containing gallium sulfate and iron each in a specified concentration were prepared. Each a 10 ml portion of the solutions was taken in an Erlenmeyer flask with a screw stopper. A specified amount of fine crystals of sodium ferrocyanide decahydrate was added to the solution in the flask under agitation with a magnetic stirrer and dissolved therein by further continued agitation for additional 1 hour. The amount of the ferrocyanide ions was in the range from equimolar to the amount of the gallium ions to 2.5 times of the equimolar amount. The flasks were then treated in the same manner as in the preceding example. The analysis of the supernatant for the concentrations of the gallium and iron ions gave the results shown in Table 2 below, which also shows the concentrations of gallium and iron in the starting aqueous solutions amount of the sodium ferrocyanide decahydrate added to the solution as well as the molar ratio thereof to the amount of the gallium ions and the % precipitation of the gallium value.

TABLE 2

| Expt. No. | Concentration in starting aqueous solution Ga, mg/liter | Fe, mg/liter | Sodium ferrocyanide decahydrate Amount, mg | Molar ratio to Ga ions | Concentration in supernatant Ga, mg/liter | Fe, mg/liter | % precipitation of Ga |
|---|---|---|---|---|---|---|---|
| 13 | 50.0 | 7.2 | 3.5 | 1.0 | 11.9 | 2.3 | 76.2 |
| 14 | 54.8 | 7.2 | 5.2 | 1.4 | 10.5 | 4.2 | 80.8 |
| 15 | 54.8 | 7.2 | 6.9 | 1.8 | 2.07 | 8.2 | 96.2 |
| 16 | 54.8 | 7.2 | 9.5 | 2.5 | 0.54 | 28.0 | 99.0 |
| 17 | 150.0 | 7.2 | 20.8 | 2.0 | 0.52 | 17.1 | 99.7 |
| 18 | 150.0 | 57.2 | 20.8 | 2.0 | 1.93 | 6.1 | 98.7 |

EXAMPLE 6

(Experiment 19)

With an object to simulate recovery of the gallium value from a Bayer's solution by neutralizing the same with carbon dioxide gas to almost completely precipitate the aluminum and gallium values and dissolving the thus obtained precipitates in a hot hydrochloric acid to give a chloride solution from which the gallium value should be recovered, an a aqueous solution was prepared which contained 165 mg of gallium, 39.9 g of aluminum chloride calculated as aluminum 55.5 g of sodium chloride and 0.11 mole of hydrogen chloride each per liter as well as a trace amount of iron. A 9.1 ml portion of the solution was taken in an Erlenmeyer flask with a screw stopper and 0.9 ml of an aqueous solution of sodium ferrocyanide in a concentration of $3.586\times10^{-2}$ mole/liter was added in drops to the aqueous solution in the flask followed by further continued agitation for 1 hour. The amount of the ferrocyanide ions added to the solution corresponded to 1.5 times by moles of the gallium ions contained in the solution. The subsequent procedure was substantially the same as in Example 5 to give a supernatant which was analyzed for the concentrations of gallium and iron to give values of 0.09 mg/liter and 11.0 mg/liter, respectively, precipitation of the gallium value was 99.9%.

EXAMPLE 7

With an object to simulate recovery of the gallium value from a Bayer's solution by neutralizing the same with carbon dioxide gas to almost completely precipitate the aluminum and gallium values and dissolving the thus obtained precipitates in a concentrated sulfuric acid to give a sulfate solution from which the gallium value should be recovered, an aqueous solution was prepared which contained 150 mg of gallium, 33.3 g of aluminum sulfate calculated as aluminum and 56.1 g of sodium sulfate each per liter as well as a trace amount of iron. A 10 ml portion of the solution was taken in an Erlenmeyer flask together with 0.0208 g of fine crystals of sodium ferrocyanide decahydrate and agitated for 1 hour with a magnetic stirrer. The amount of the ferrocyanide ions added was twice by moles of the gallium ions. Subsequent treatment of the solution was substantially the same as in the preceding example to give a supernatant which was analyzed for the concentrations of gallium and iron to give values of 0.54 mg/liter and 19.2 mg/liter, respectively. Precipitation of the gallium value was 99.6%.

What is claimed is:

1. A method for the recovery of a gallium value from an aqueous solution produced by the Bayer process containing an aluminum salt as a principal solute and gallium ions which consists of:

(a) admixing the aqueous solution with a ferrocyanide compound soluble in water to selectively precipitate the gallium value in the form of gallium ferrocyanide, the amount of the ferrocyanide compound being in the range from 1.0 to 2.5 times the moles of the gallium ions contained in the aqueous solution when the concentration of gallium in the aqueous solution is larger than 50 mg/liter and at least equimolar to the gallium is contained in the solution but not exceeding such an amount to give a concentration of about $1.8\times10^{-3}$ mole/liter thereof in the solution when the concentration of gallium in the aqueous solution does not exceed 50 mg/liter; and (b) separating the precipitate of the gallium ferrocyanide from the solution.

2. The method for the recovery of a gallium value from an aqueous solution containing an aluminum salt as a principal solute and a trace amount of gallium ions as claimed in claim 1 wherein the ferrocyanide compound soluble in water is sodium ferrocyanide.

* * * * *